US007524354B2

(12) United States Patent
Zhong et al.

(10) Patent No.: US 7,524,354 B2
(45) Date of Patent: Apr. 28, 2009

(54) CONTROLLED SYNTHESIS OF HIGHLY MONODISPERSED GOLD NANOPARTICLES

(75) Inventors: Chuan-Jian Zhong, Johnson City, NY (US); Peter N. Njoki, Binghamton, NY (US); Jin Luo, Binghamton, NY (US)

(73) Assignee: Research Foundation of State University of New York, Binghamton, NY (US)

( * ) Notice: Subject to any disclaimer, the term of this patent is extended or adjusted under 35 U.S.C. 154(b) by 313 days.

(21) Appl. No.: 11/176,021

(22) Filed: Jul. 7, 2005

(65) Prior Publication Data

US 2007/0125196 A1 Jun. 7, 2007

(51) Int. Cl.
*B22F 9/00* (2006.01)

(52) U.S. Cl. ..... 75/370; 75/343

(58) Field of Classification Search ..... 75/330, 75/370, 343, 371, 392, 416, 420, 421, 423, 75/426, 428, 710, 711, 732, 736
See application file for complete search history.

(56) References Cited

U.S. PATENT DOCUMENTS

| | | | |
|---|---|---|---|
| 5,560,960 | A | 10/1996 | Singh et al. |
| 5,585,020 | A | 12/1996 | Becker et al. |
| 6,562,403 | B2 | 5/2003 | Klabunde et al. |
| 6,818,199 | B1 | 11/2004 | Hainfeld et al. |
| 6,872,971 | B2 | 3/2005 | Hutchinson et al. |
| 2002/0160195 | A1 | 10/2002 | Halas et al. |
| 2002/0174743 | A1 | 11/2002 | Mukherjee et al. |
| 2002/0194958 | A1 | 12/2002 | Lee et al. |
| 2003/0029274 | A1 | 2/2003 | Natan et al. |
| 2004/0115345 | A1 | 6/2004 | Huang et al. |
| 2004/0261574 | A1 | 12/2004 | Lin et al. |

FOREIGN PATENT DOCUMENTS

| | | |
|---|---|---|
| JP | 6271905 | 9/1994 |

OTHER PUBLICATIONS

Nikhil R. Jana, Latha Gearheart, and Catherine J. Murphy, "Seeding Growth for Size Control of 5-40 nm Diameter Gold Nanoparticles," Langmuir 2001, American Chemical Society, 17, 6782-6786.*

Irshad Hussain, Mathias Brust, Adam J. Papworth, and Andrew I. Cooper, "Preparation of Acrylate-Stabilized Gold and Silver Hydrosols and Gold-Polymer Composite Films," Langmuir 2003, American Chemical Society, 19, 4831-4835.*

(Continued)

*Primary Examiner*—Roy King
*Assistant Examiner*—Jie Yang
(74) *Attorney, Agent, or Firm*—Nixon Peabody LLP

(57) ABSTRACT

A method of synthesizing highly monodispersed Au nanoparticles having diameters in the range of 30-90 nm. Seed nanoparticles in a controlled concentration are combined with a precursor, also in a controlled concentration, a reducing and capping agent (e.g., sodium acrylate) in aqueous solution. Under controlled conditions of pH, temperature, and time, highly monodispersed nanoparticles having diameters in the range of 30-100 nm are produced. A relative size standard deviation of the size distribution of the resulting nanoparticles is as low as 2%.

18 Claims, 7 Drawing Sheets

OTHER PUBLICATIONS

Tapan K. Sau, Anjali Pal, N.R. Jana, Z.L. Wang, and Tarasankar Pal, "Size controlled synthesis of gold nanoparticles using photochemically prepared seed particles," Journal of Nanoparticle Research 2001, Kluwer Academic, 3, 257-261.*

NPL: Maye et al, "Size-controlled assembly of gold nanoparticles induced by a tridentate thioether ligand", J. Am. Chem. Soc., 2003, 125, pp. 9906-9907.*

* cited by examiner

CONTROLLED SYNTHESIS OF HIGHLY MONODISPERSED GOLD NANOPARTICLES

FIELD OF THE INVENTION

The invention pertains to processing nanoparticles and, more particularly to a method of growing highly monodispersed gold nanoparticles having readily controlled sizes and shapes.

BACKGROUND OF THE INVENTION

Gold nanoparticles are one of the most widely used classes of nanomaterials for chemical, bioanalytical, biomedical, optical and nanotechnological applications. While numerous methods are known for the synthesis of gold nanoparticles, the ability to control the size, shape and monodispersity of such gold nanoparticles is one of the most important areas for the targeted applications. This is because the electronic, optical, and chemical/biological properties exploited in these applications are highly dependent on the size, shape and size monodispersity of the nanoparticles. Few standard protocols have been established to allow preparation of gold nanoparticles of the desired sizes, shapes and high monodispersity in a systematic way. Such ability is critical for the targeted applications.

One method of the prior art for providing size monodispersed nanoparticles involves forming polydispersed nanoparticles using a variety of techniques known to those of skill in the art. Nanoparticles of a selected size range may then be selected from the polydispersed population using an instrument such as a differential mobility analyzer (DMA). Because the size resolution of a typical DMA is only about 10%, the degree of size monodispersity of the selected nanoparticles is similarly low.

Other techniques are known to those skilled in the art. Prior art techniques generally provide populations of gold nanoparticles in the size range of 2 to 30 nm diameter having best case size monodisperities of approximately 5-10%.

The present invention, however, provides a nanoparticle production technique that involves seeded growth of gold nanoparticles to form almost any desired size in the range of approximately 30-90 nm diameters. Nanoparticles formed in accordance with the inventive method exhibit size monodispersity having as small as a 2% relative standard deviation. This is significantly better than methods of the prior art for at least two reasons. First, highly size monodispersed nanoparticles having any desired diameter in the range of approximately 30-90 nm may be repeatably formed. This provides size control not heretofore available. Second, as previously mentioned, size monodisperity with relative standard deviations as low as 2% are achieved using the method of the invention.

SUMMARY OF THE INVENTION

In accordance with the present invention, there is provided a method for synthesizing highly size monodispersed Au nanoparticles having diameters in the range of 30-90 nm. The novel technique uses a seed nanoparticle and then grows larger sized gold nanoparticles on the seed. Both the seeding and the seeded growth typically involves the use of the same reducing and capping agent (e.g., acrylate) in aqueous solution under controlled conditions. The inventive method is highly effective for the preparation of 30-90 nm sized gold nanoparticles with controllable sizes and high monodispersity.

Typically, Au nanoparticles having small diameters (e.g., 30 nm) are first synthesized using acrylate (A) as both a reducing and capping agent and $AuCl_4^-$ as an Au-precursor, as is well known in the art. The smaller sized particles produced in this manner are used as seeds to grow larger-sized nanoparticles. This is achieved by mixing a controlled quantity of seeds with an $AuCl_4^-$-A solution, the concentrations which are controlled, as is the pH and temperature. By varying parameters including concentration, pH, temperature, and reaction time, highly size monodispersed Au nanoparticles having desired size and shape are fabricated.

It is, therefore, an object of the invention to provide a method of fabricating highly size monodispersed nanoparticles having a predetermined nominal size.

It is another object of the invention to provide a method of fabricating highly size monodispersed gold nanoparticles having a predetermined nominal size.

It is an additional object of the invention to provide a method of fabricating highly size monodispersed gold nanoparticles having a relative standard deviation of no more than approximately 2%.

It is a further object of the invention to provide a method of fabricating highly size monodispersed gold nanoparticles grown from gold seed nanoparticles of approximately 30 nm diameters.

It is a still further object of the invention to provide a method of fabricating highly size monodispersed gold nanoparticles having controlled shapes.

BRIEF DESCRIPTION OF THE DRAWINGS

A complete understanding of the present invention may be obtained by reference to the accompanying drawings when considered in conjunction with the subsequent detailed description, in which.

DETAILED DESCRIPTION OF THE PREFERRED EMBODIMENT

Figure 1:
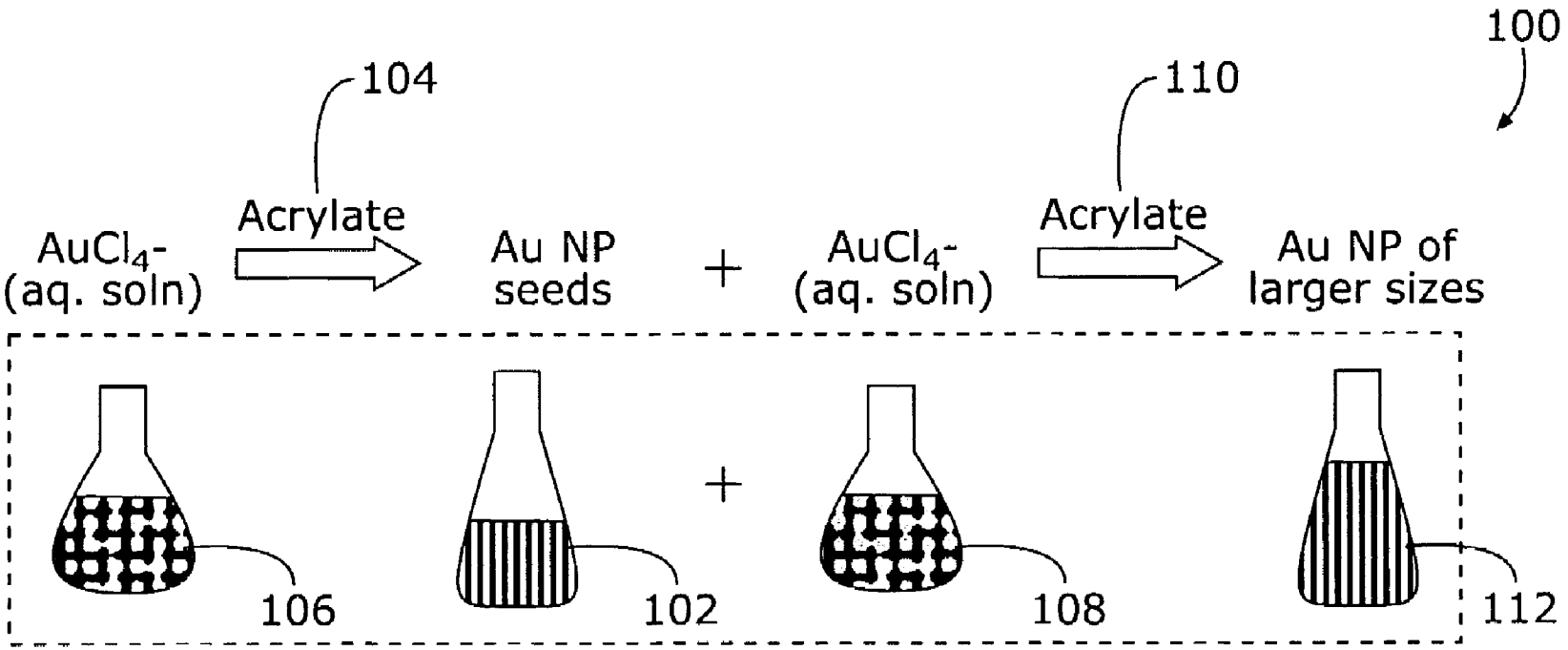
FIG. 1 is a schematic representation of the process of Au nanoparticle seed formation followed by seed-mediated growth into larger sized Au nanoparticles in accordance with the method of the invention.

The present invention provides methods for controllably forming highly size monodispersed gold (Au) nanoparticles of any desired size and shape. Sizes in the range of approximately 30-90 nm or larger may be formed using the inventive method. It will be recognized that extensions of the novel method may be expected to produce nanoparticles outside the range of 30-90 nm, so the inventive method is not limited to the particular size range of nanoparticles chosen for purposes of disclosure. It will also be recognized that while the method chosen for purposes of disclosure are directed to Au nanoparticles, it is reasonable to expect that the inventive method may be applied to other compositions of nanoparticles. Consequently, the invention is not considered limited to gold or gold alloy nanoparticles but encompasses nanoparticles of any composition.

One embodiment of the inventive method uses Au nanoparticles of a smaller size (e.g., 30 nm diameter) as seed particles. Au nanoparticles of approximately 30 nm diameter may be synthesized by a number of methods. One such method is described in the papers: Jana, N. R.; Gearheart, L.; Murphy, C. J., Seeding Growth for Size Control of 5-40 nm Diameter Gold Nanoparticles, Langmuir 2001, Volume 17, No. 22, pages 6782-6786 (hereinafter JANA et al.); and Hussain, I.; Brust, M.; Papworth, A. J.; Cooper, A. I., Preparation of Acrylate-Stabilized Gold and Silver Hydrosols and Gold-Polymer Composite Films, Langmuir 2003, Volume 19, No. 11, pages 4831-4835 (hereinafter HUSSAIN et al.). Both these references are included herein by reference. It will be understood, however, that the formation of the seed Au nanoparticles forms no part of the instant invention and seed nanoparticles formed using different methods may also be used to practice the invention.

The synthesis of Au nanoparticles as described by JANA et al. uses trisodium citrate as a capping agent and $AuCl_4^-$ is reduced using sodium borohydride. However, pH adjustment is not performed. A stabilizing agent, cetyltrimethylammonium bromide (CTAB) is also used. Particles produced using the JANA et al. method are smaller in size compared to those synthesized in accordance with the method of the invention. In the JANA et al. method, first, seeds having a diameters of approximately 3.5±0.7 nm are prepared. These seeds are then used to synthesize larger particles with diameters in the range of approximately 5.5±0.6 nm and 8.0±0.8 nm by varying CTAB and seeds (3.5±0.7 nm) quantities. Then, using 8.0±0.8 nm particles as seeds, particles having a diameter of approximately 17.0±2.5 nm are formed. Finally, using these 17 nm particles again as seeds, larger particles of approximately 35±5 nm are obtained.

In the synthesis of Au nanoparticles method described by HUSSAIN et al., sodium acrylate is used both as a capping and as a reduced agent. An aqueous solution of $HAuCl_4$ is refluxed (100° C. ) for 5-10 min, and a warm (50-60° C.) aqueous solution of sodium acrylate is then added. Reflux is continued for another 30 min until a deep-red solution is observed. No pH adjustment step is used. No seeding based growth was reported in this work.

Referring first to FIG. 1, there is shown a schematic representation 100 of the first embodiment of the method of the invention. Seed Au gold nanoparticles 102 are first synthesized using sodium acrylate (A) 104 as both reducing agent and the capping agent and $AuCl_4^-$ 106 as Au-precursor using a modified method as described by HUSSAIN et al and/or JANA et al. In the modification, the pH was adjusted to 7 and the reaction was carried out at room temperature. The production of the seed Au nanoparticles 102 forms no part of the present invention. The small sized seed nanoparticles 102 are then used as seed to grow larger-sized nanoparticles 112. This growth is achieved by mixing a controlled quantity of seed 102 with $AuCl_4^-$ precursor solution 108 with acrylate (A) 110. Other possible reducing and/or capping agents include sodium citrate and sodium borohydride.

The reducing and capping agents may be different materials, like the synthesis by Jana et al. as a reducing and capping solution 108 at a controlled concentration and under controlled pH and temperatures. The pH may be controlled by addition of dilute aqueous sodium hydroxide solution and/or dilute hydrochloric acid. This process yields larger diameter, highly size monodispersed nanoparticles.

Providing the preformed seeds (as nucleation centers) and by controlling the growth condition, the resulting nanoparticle size may be controlled by varying both the concentration of the seeds and the concentration of the metal precursor ($AuCl_4^-$). In addition to controlling the concentrations, controlling both the pH of the reaction solution and the reaction temperature is essential for controlled nanoparticle growth. The resulting Au nanoparticles exhibit the predetermined, desired average size and have high size monodispersity. If necessary, particles having different sizes may be separated from excess reducing/capping agents by centrifugation or any other suitable process.

Table 1 provides specific experimental conditions for the synthesis of the Au seeds and the subsequent growth of the seeds into larger sized Au nanoparticles of several different sizes.

TABLE 1

Experimental conditions for the synthesis of Au seeds and the subsequent growth SEEDED Au NANOPARTICLES IN AQUEOUS SOLUTION

| Seeds | $AuCL_4^-$ (mM) | Acrylate (M) | Seed Vol:Total Vol | Seed Conc. (Particles/mL) | Stirring | size (nm) |
|---|---|---|---|---|---|---|
| To make 30.5 nm seeds | 0.1705 | 0.01024 | 250 | — | Yes | 30.5 ± 1.2 |
| Using 30.5 nm seeds | 0.05 | 0.01024 | 25:125 | $1.17 \times 10^{11}$ | Yes | 45.5 ± 1.6 |
| Using 30.5 nm seeds | 0.0853 | 0.01024 | 25:125 | $1.17 \times 10^{11}$ | Yes | 53.7 ± 1.7 |
| Using 30.5 nm seeds | 0.1705 | 0.01024 | 25:125 | $1.17 \times 10^{11}$ | Yes | 61.9 ± 2.1 |

TABLE 1-continued

Experimental conditions for the synthesis of Au seeds and the subsequent growth
SEEDED Au NANOPARTICLES IN AQUEOUS SOLUTION

| Seeds | $AuCL_4^-$ (mM) | Acrylate (M) | Seed Vol:Total Vol | Seed Conc. (Particles/mL) | Stirring | size (nm) |
|---|---|---|---|---|---|---|
| Using 62 nm seeds | 0.1705 | 0.01024 | 25:125 | $1.39 \times 10^{10}$ | No | 82.4 ± 2.6 |
| Using 62 nm seeds | 0.1705 | 0.01024 | 25:125 | $1.39 \times 10^{10}$ | Yes | 92.5 ± 2.8 |

1) The pH is adjusted to 7 before adding Sodium acrylate (A)
2) The reaction performed at room temperature i.e. 18-30° C.
3) The reaction time is 1-3 days As may be seen from the data of Table 1, depending on the size of the seeds, larger sized particles can be produced under the indicated conditions.

Figure 2A:
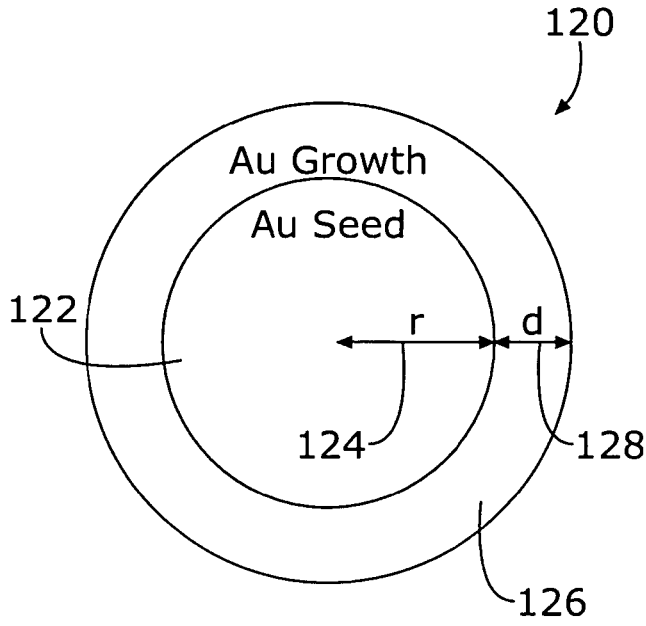
FIG. 2*a* is a schematic, cross-sectional view of a nanoparticle formed in accordance with the method of the invention.

Referring now to FIG. 2*a,* there is shown a schematic, cross-sectional view of a nanoparticle 120 indicating the seed and the grown portions 122, 126, respectively. The core 122 of nanoparticle 120 (i.e., seed) has a radius r 124. The growth portion 126 of nanoparticle 120 has a thickness d 128.

The theoretical growth thickness d 128 may be calculated based on a spherical model for an r (radius)-sized seed and the density value for bulk gold. Equation 1 predicts growth thickness d as a function of the concentration of $AuCl_4^-$ ($C_{mM}$). For the first seeded growth, the growth thickness ($d_1$) may be expressed as:

$$d_1 = r\left(\sqrt[3]{1 + 197 \times 10^{-6} \times C_{mM} \frac{V_{G_1} \times V_{S_1}}{M_{Au_1} \times V'_{S_1}}} - 1\right) \quad (1)$$

By substituting experimental parameters, such as r, $V_{G1}$, $V_{S1}$, $V'_{S1}$ and $M_{Au1}$, Equation 1 may be simplified:

$$d_1 = r(\sqrt[3]{1+29.3C_{mM}} - 1) \quad (2)$$

where:
$d_1$=growth thickness (nm) for the first-seeding growth;
r=radius of Au nanoparticle seeds (e.g., 15.2 nm);
$V_{G1}$=growth solution total volume (mL);
$V_{S1}$=total volume of the seed stock solution (mL);
$V'_{S1}$=volume removed from the seed stock solution (mL)
$M_{Au1}$=mass of Au used to synthesize Au 30.5 nm seeds (g); and
$C_{mM}$=concentration of HAuCl4 in the growth solution (mM).

For the second seeded growth, the growth thickness ($d_2$) may be expressed as:

$$d_2 = r\left(\sqrt[3]{1 + 197 \times 10^{-6} \times C_{mM} \frac{V_{G2} \times V_{S2}}{V'_{S2}\left(M_{Au1} \frac{V_{S1}}{V'_{S1}} + M_{Au2}\right)}} - 1\right) \quad (3)$$

By substituting the experimental parameters such as r, $V_{G1}$, $V_{S1}$, $V'_{S1}$ and $M_{Au1}$, the Equation 3 may be simplified:

$$d_2 = r(\sqrt[3]{1+4.9C_{mM}} - 1) \quad (4)$$

where:
$d_2$=growth thickness (nm) for the second-seeding growth;
r=radius of Au nanoparticle seeds (e.g., 31 nm);
$V_{G2}$=growth solution total volume (mL);
$V_{S2}$=seed 62 nm synthesis total solution volume (stock seed solution) (mL);
$V'_{S2}$=volume taken out from the 62 nm seed stock solution (mL);
$M_{Au2}$=mass of Au used to synthesize Au 62 nm seeds (g); and
$C_{mM}$=concentration of HAuCl4 in the growth solution (mM).

The spherical model used for deriving Equations 1 and 3 assume 100% conversion efficiency.

Figure 2B:
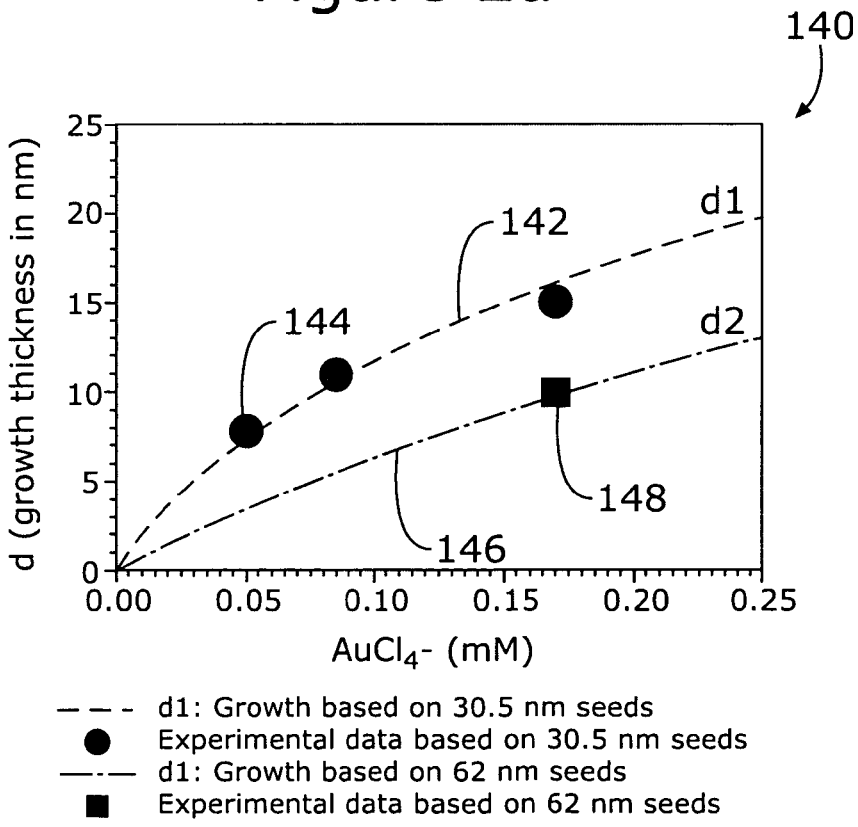
FIG. 2*b* is a graph showing differences between theoretical and achieved diameters of nanoparticles formed in accordance with the invention.

Referring now to FIG. 2*b,* there is shown a plot 140 of theoretical vs. experimental data of the growth thicknesses vs. the concentration of $AuCl_4^-$. Curve 142 ($d_1$) is derived from Equation 2 and represents 30 nm seeds. Curve 146 ($d_2$) is derived from Equation 4 and represents 62 nm seeds. Data points 144 and 148 represent actual test results from experiments such as those provided in Table 1. As may readily be seen, there is generally good agreement between the theoretical and the measured results within the indicated range of $AuCl_4^-$ concentrations, assuming an approximately 65% conversion efficiency for the formation of the 30 nm diameter gold nanoparticle seeds.

In principle, the particle sizes ranging from 30 nm to 100 nm diameters may be produced in a quantitative way by controlling the concentration of $AuCl_4^-$ and the size of the seeds.

One aspect of the present invention is directed toward a method of preparing highly monodispersed gold nanoparticles. The method includes providing seed nanoparticles at a predetermined concentration, where the seed particles have a predetermined diameter. The seed particles are combined with a precursor at a predetermined concentration. At least one reducing and capping agent is combined with the combination of seed nanoparticles and the precursor. The following parameters of pH, temperature, reaction time, or amount of stirring are controlled so that highly monodispersed nanoparticles with a predetermined size are grown. The seed nanoparticles may have a diameter in the range of approximately 30 to 62 nm, while the resultant nanoparticles have diameter in the range of approximately 30 to 100 nm. The concentration of seed nanoparticles can be within the range of approximately $1\times10^{10}$ to $2\times10^{11}$ particles/mL. The concentration of precursor can be within the range of 0.05 to 0.2 M, while the pH is controlled within the range of 6.5 to 7.5.

Several examples are provided herein to demonstrate the simplicity and effectiveness of the inventive technique. In these examples, 35.0 nm diameter gold particles were used as seeds to synthesize Au nanoparticles of sizes 46 nm, 54 nm, 62 nm and 82 nm that are highly monodispersed in size. As used herein, the term highly monodispersed size is intended to represent a size distribution of nanoparticle sizes wherein a relative standard deviation of the distribution is approximately 2%-5%. The morphology and size of the gold nanoparticles were examined using a transmissive electron microscope (TEM).

Figure 3A:
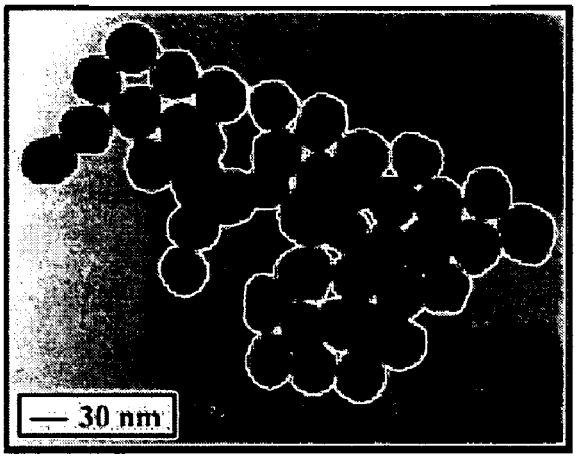
FIGS. 3*a* and 3*b* are a TEM micrograph and a size distribution, respectively, of 35.7 nm diameter seed nanoparticles formed using a method of the prior art.
Figure 3B:
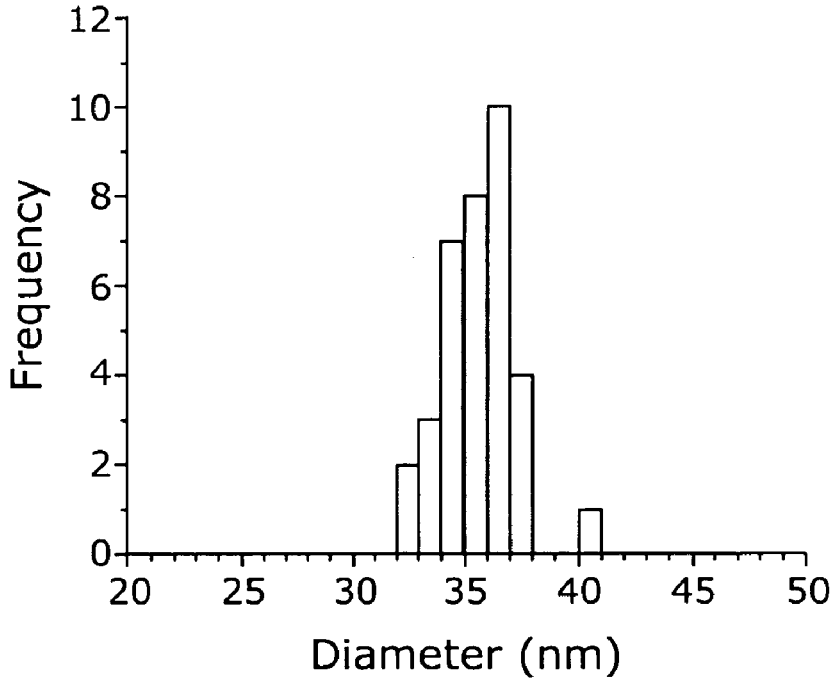
Prior Art Figure 3b

FIGS. 3*a* and 3*b* show, respectively, a TEM micrograph and a size distribution, respectively, of a first sample of Au nanoparticle seeds obtained in the laboratory using the procedures of JANA et al. and/or HUSSAIN et al. The preparation steps for the 35.7 nm particles are:

Conditions for preparing 35.7-nm NANOPARTICLE SEEDS IN AQUEOUS SOLUTION

| Seeds/nm | $AuCL_4^-$ (mM) | Acrylate (M) | Total Vol | Seed Conc. (Particles/mL) | Stirring | Final size (nm) |
|---|---|---|---|---|---|---|
| Synthesis of 35.7 nm seeds | 0.1705 | 0.01024 | 250 | — | No | 35.7 ± 1.6 |

Notes:
1) The pH is adjusted to 7 before adding Sodium acrylate (A);
2) The reaction performed at room temperature i.e. 20-24° C.; and
3) The reaction time is 3-4 days.

The TEM data for the particle seeds display an average diameter of 35.7±1.6 nm.

Figure 4A:
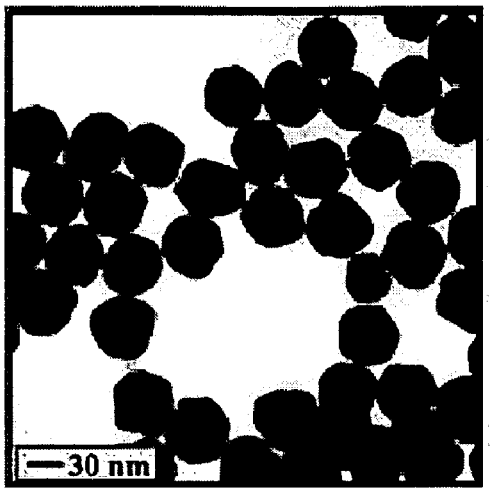
FIGS. 4*a* and 4*b* are a TEM micrograph and a size distribution, respectively, of approximately 54.4-nm diameter nanoparticles formed using the seed nanoparticles of FIGS. 3*a* and 3*b;*
Figure 4B:
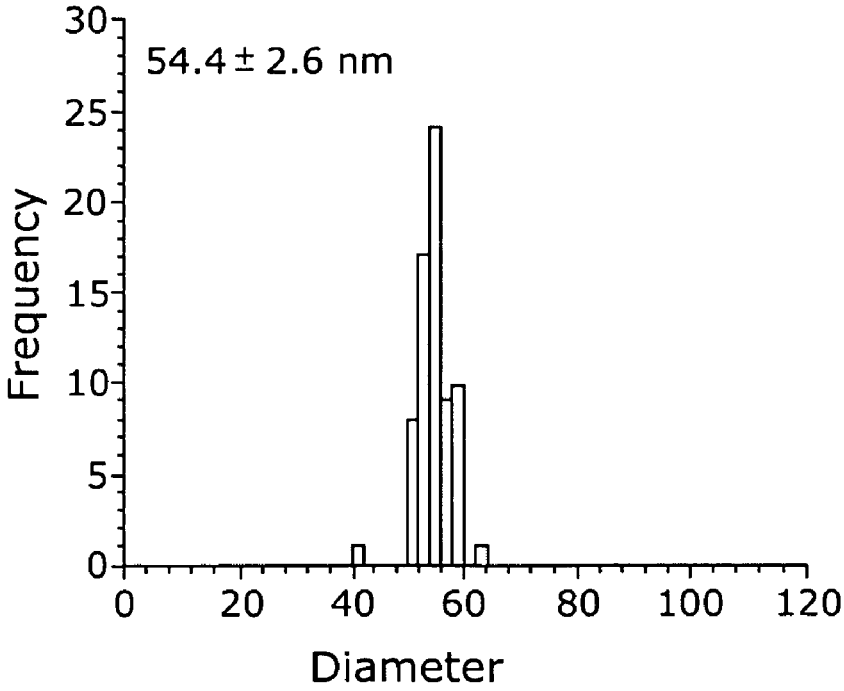

FIGS. 4*a* and 4*b* show a TEM micrograph and a size distribution, respectively, for nanoparticles synthesized using the 35.7 nm particles of FIGS. 3*a* and 3*b* as seeds. The preparation steps for the 54.4 nm particles are:

Conditions for preparing 54.4 nm NANOPARTICLES IN AQUEOUS SOLUTION

| Seeds | $AuCL_4^-$ (mM) | Acrylate (M) | Seed Vol:Total Vol | Seed Conc. (Particles/mL) | Stirring | size (nm) |
|---|---|---|---|---|---|---|
| 35.7-nm seeds | 0.1705 | 0.01024 | 25:125 | $1.17 \times 10^{11}$ | No | 54.4 ± 2.6 |

Notes:
1) The pH is adjusted to 7 before adding Sodium acrylate (A);
2) The reaction performed at 4° C.; and
3) The reaction time is 7-10 days.

The average size for the resulting nanoparticles (FIGS. 4*a*, 4*b*) was 54.4±2.6 nm, the relative standard deviation being approximately 5%.

Figure 5A:
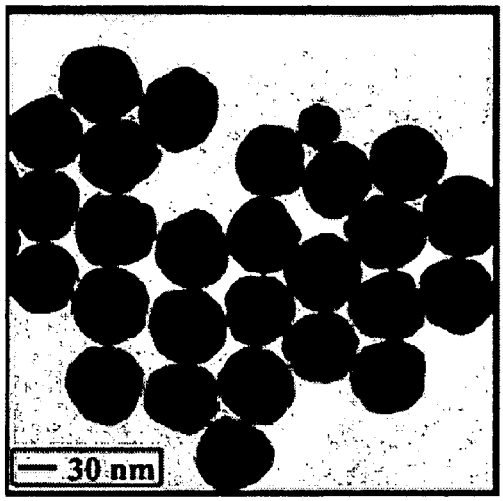
FIGS. 5*a* and 5*b* are a TEM micrograph and a size distribution, respectively, of approximately 62 nm diameter nanoparticles formed using the seed nanoparticles of FIGS. 3*a* and 3*b;*
Figure 5B:
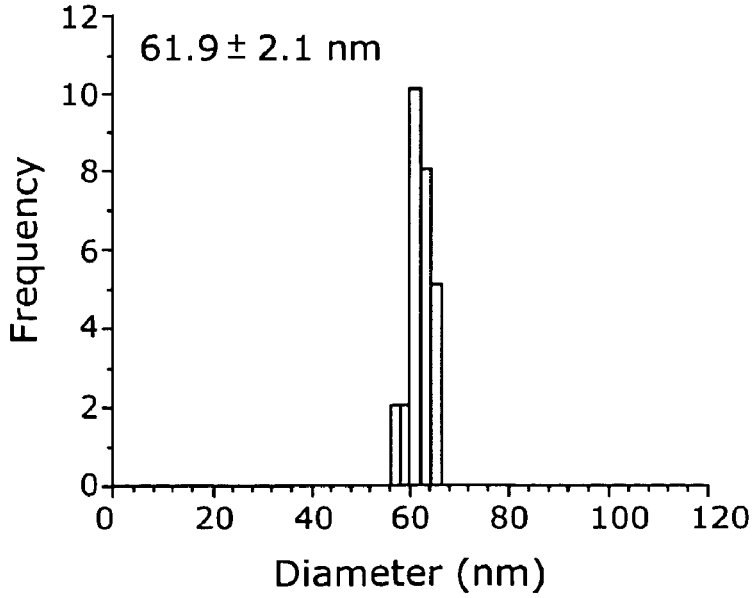

FIGS. 5*a* and 5*b* show a second example of TEM data for nanoparticles synthesized using the 35 nm sized particles (FIGS. 3*a*, 3*b*) as seeds. The preparation steps for the 62 nm particles are:

Conditions for preparing 62 nm NANOPARTICLES IN AQUEOUS SOLUTION

| Seed Size | $AuCL_4^-$ (mM) | Acrylate (M) | Seed Vol:Total Vol | Seed Conc. (Particles/mL) | Stirring | size (nm) |
|---|---|---|---|---|---|---|
| 35.7 nm | 0.1705 | 0.01024 | 25:125 | $1.17 \times 10^{11}$ | No | 61.9 ± 2.1 |

Notes:
1) The pH is adjusted to 7 before adding Sodium acrylate;
2) The reaction temperature is 20-24° C.; and
3) The reaction time is 2 to 4 days.

Figure 6A:
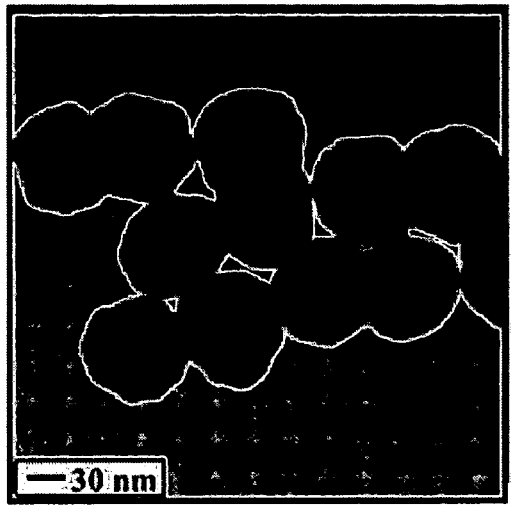
FIGS. 6*a* and 6*b* are a TEM micrograph and a size distribution, respectively, of approximately 82.4 nm diameter nanoparticles formed using the seed nanoparticles of FIGS. 5*a* and 5*b.
Figure 6B:
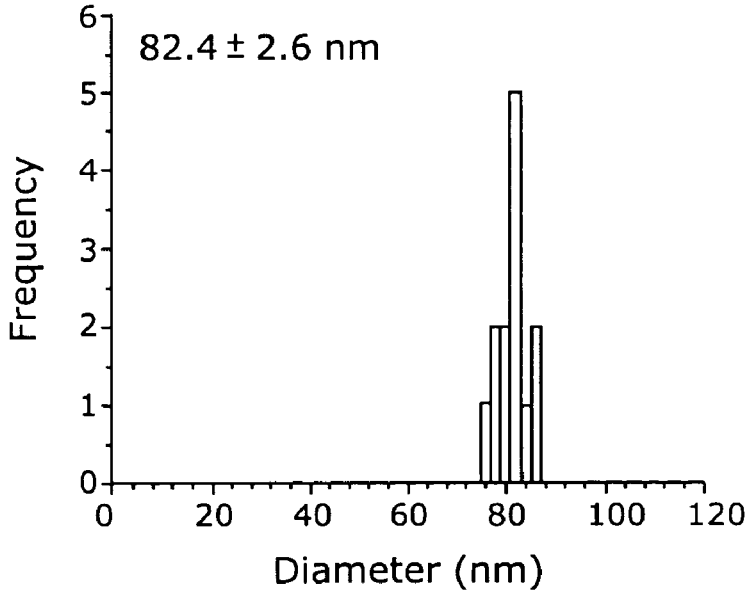

It should be recognized that nanoparticles synthesized in a first stage may be used as seed particles for a subsequent synthesis process. FIGS. 6*a* and 6*b* are a TEM micrograph and size distribution, respectively, for nanoparticles synthesized using the 62 nm sized particles (FIGS. 5*a*, 5*b*) as seeds. The preparation steps for the 82 nm particles are:

Conditions for preparing 82.4 nm NANOPARTICLES IN AQUEOUS SOLUTION

| Seed size | $AuCL_4^-$ (mM) | Acrylate (M) | Seed Vol:Total Vol | Seed Conc. (Particles/mL) | Stirring | size (nm) |
|---|---|---|---|---|---|---|
| 62 nm | 0.1705 | 0.01024 | 25:125 | $1.39 \times 10^{10}$ | No | 82.4 ± 2.6 |

Notes:
1) The pH is adjusted to 7 before adding Sodium acrylate;
2) the reaction temperature is 20-24° C.; and
3) the reaction time is 2 to 4 days.

The average size for the resulting nanoparticles (FIGS. 6*a*, 6*b*) was 82.4±2.6 nm. The relative standard deviation is approximately 2%.

In addition to the above examples, a variety of highly monodispersed Au nanoparticles of several other sizes between approximately 30 and 90 nm diameters have been produced by manipulating the relative concentrations of the Au seed, Au-precursor and capping agents under controlled conditions.

The particles below 80 nm were well suspended in the aqueous solution for months without precipitation, whereas the suspension of particles of sizes above 80 nm was stable for at least 3 days before precipitation occurred. The precipitated particles can be easily re-dispersed in the solution by brief sonication.

It was also noted that the seeded growth of Au nanoparticles can be easily monitored by UV/Visible spectrophotometric measurement.

Figure 7:
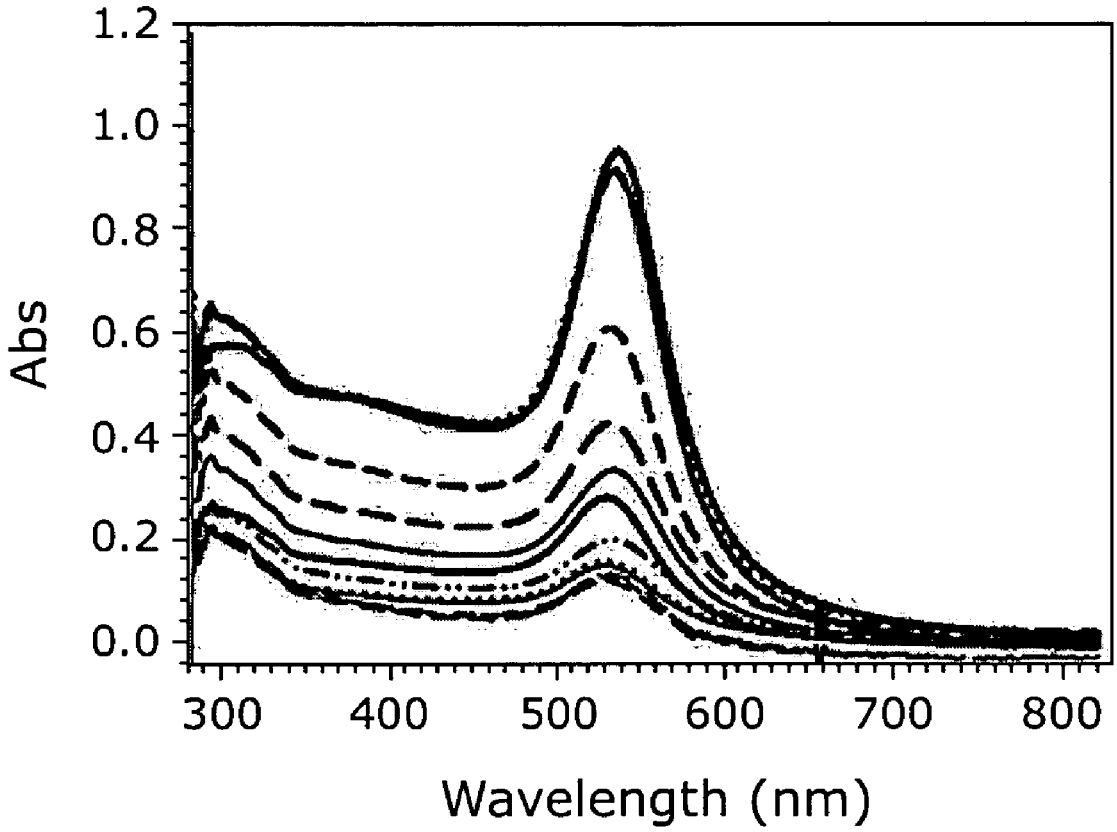
* and FIG. 7 is a series of plots of absorbance versus wavelength containing a set of UV/Visible spectrophotometric spectra images monitoring the growth of nanoparticles formed in accordance with the inventive method. The increase of the absorbance for the surface plasmon resonance band at 530nm is consistent with the growth of the nanoparticle.

Referring now to FIG. 7, the increase of the absorbance for the surface plasmon resonance band at 530 nm is consistent with the growth of the Au nanoparticles observed in the TEM micrographs.

In summary, the method of the present invention provides a simple and highly effective technique for synthesizing monodispersed gold nanoparticles in the size range of 30-90 nm diameters. This technique is shown to produce highly monodispersed Au nanoparticles of almost any sizes between 30 and 100 nm diameters. The size monodispersity is much higher than most commercial Au nanoparticles. For example, Au nanoparticles of ~80 nm core sizes obtained in accordance with the method of the invention were compared with Au particles from a well known commercial nanoparticle source. The Au particles from a sample of the Au 80 nm particle solution from the commercial source showed an average size of 76.9±4.6 nm and an SP band at 550 nm. The Au nanoparticles prepared in accordance with the invention showed an average size of 82.4±2.6 nm and an SP band at 554 nm. The particle concentrations of the nanoparticles prepared in accordance with the inventive method are on the order of 1011 or 1010 particles per mL, comparable with the concentration of commercially available products.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is clamed is:

1. A method of preparing highly monodispersed gold nanoparticles, said method comprising:

a) providing seed nanoparticles;

b) combining said seed nanoparticles with a gold precursor;

c) combining an acrylate reducing and capping agent with said combination of said seed nanoparticles and said gold precursor to form a reaction mixture; and d) growing highly monodispersed gold nanoparticles from the reaction mixture at a temperature of up to 30° C., wherein the monodispersed gold nanoparticles have a size distribution with a relative standard deviation of less than 5% and a diameter of 30-100 nm.

2. The method of preparing highly monodispersed gold nanoparticles as recited in claim 1, wherein said gold precursor comprises $AuCl_4^-$.

3. The method of preparing highly monodispersed gold nanoparticles as recited in claim 1, wherein said seed nanoparticles have a diameter in the range of 30 to 62 nm.

4. The method of preparing highly monodispersed gold nanoparticles as recited in claim 1, wherein a concentration of seed nanoparticles is within the range of $1\times10^{10}$ to $2\times10^{11}$ particles/mL.

5. The method of preparing highly monodispersed gold nanoparticles as recited in claim 1, wherein a concentration of the gold precursor in said combination of said seed nanoparticles and said gold precursor is within the range of 0.05 to 0.2 M.

6. The method of preparing highly monodispersed gold nanoparticles as recited in claim 1, wherein said combination of said seed nanoparticles and said gold precursor is controlled to a pH within the limits of 6.5 to 7.5.

7. The method of preparing highly monodispersed gold nanoparticles as recited in claim 1, the steps further comprising:

e) centrifuging the reaction mixture containing said resultant nanoparticles.

8. A method of preparing highly monodispersed gold nanoparticles, the steps comprising:

a) providing seed nanoparticles;

b) combining said seed nanoparticles with a gold precursor;

c) combining an acrylate reducing and capping agent with said combination of said seed nanoparticles and said gold precursor to form a reaction mixture;

d) growing highly monodispersed gold nanoparticles from the reaction mixture at a temperature of up to 30° C., wherein the monodispersed gold nanoparticles have a size distribution with a relative standard deviation of less than 5% and a diameter of 30-100 nm; and e) repeating steps b), c), and d) using the gold nanoparticles resulting from said growing.

9. The method of preparing highly monodispersed gold nanoparticles as recited in claim 8, wherein said gold precursor comprises $AuCl_4^-$.

10. The method of preparing highly monodispersed gold nanoparticles as recited in claim 8, wherein said seed nanoparticles have a diameter in the range of 30 to 62 nm.

11. The method of preparing highly monodispersed gold nanoparticles as recited in claim 8, wherein a concentration of seed nanoparticles is within the range of $1\times10^{10}$ to $2\times10^{11}$ particles/mL.

12. The method of preparing highly monodispersed gold nanoparticles as recited in claim 8, wherein a concentration of the gold precursor in said combination of said seed nanoparticles and said gold precursor is within the range of 0.05 to 0.2 M.

13. The method of preparing highly monodispersed gold nanoparticles as recited in claim 8, wherein said combination of said seed nanoparticles and said gold precursor is controlled to a pH within the limits of 6.5 to 7.5.

14. The method of preparing highly monodispersed gold nanoparticles as recited in claim 8, the steps further comprising:

f) centrifuging the reaction mixture containing said resultant nanoparticles.

15. The method of preparing highly monodispersed gold nanoparticles as recited in claim 1, wherein the reaction mixture temperature is from 4° C. to 30° C.

16. The method of preparing highly monodispersed gold nanoparticles as recited in claim 1, wherein the monodispersed gold nanoparticles have a size distribution with a relative standard deviation of 2-5%.

17. The method of preparing highly monodispersed gold nanoparticles as recited in claim 8,wherein the reaction mixture temperature is from 4° C. to 30° C.

18. The method of preparing highly monodispersed gold nanoparticles as recited in claim 8, wherein the monodispersed gold nanoparticles have a size distribution with a relative standard deviation of 2-5%.

* * * * *